US011414265B2

(12) United States Patent
Siemens

(10) Patent No.: US 11,414,265 B2
(45) Date of Patent: Aug. 16, 2022

(54) HOPPER BOTTOM FOR STORAGE BIN WITH INTEGRAL AERATION

(71) Applicant: Meridian Manufacturing, Inc., Winnipeg (CA)

(72) Inventor: Franz Wall Siemens, Forrest (CA)

(73) Assignee: Meridian Manufacturing, Inc., Winnipeg (CA)

( * ) Notice: Subject to any disclaimer, the term of this patent is extended or adjusted under 35 U.S.C. 154(b) by 479 days.

(21) Appl. No.: 16/299,650

(22) Filed: Mar. 12, 2019

(65) Prior Publication Data

US 2019/0329971 A1 Oct. 31, 2019

Related U.S. Application Data

(60) Provisional application No. 62/663,666, filed on Apr. 27, 2018.

(51) Int. Cl.

| | |
|---|---|
| ***B65D 88/74*** | (2006.01) |
| ***B65D 88/72*** | (2006.01) |
| ***B65D 3/06*** | (2006.01) |
| ***F26B 25/06*** | (2006.01) |
| ***F26B 17/12*** | (2006.01) |
| ***F26B 9/06*** | (2006.01) |
| ***B67C 11/02*** | (2006.01) |

(52) U.S. Cl.

CPC ..... *B65D 88/745* (2013.01); *B65D 3/06* (2013.01); *B65D 88/72* (2013.01); *F26B 17/12* (2013.01); *F26B 25/06* (2013.01); *B67C 11/02* (2013.01); *F26B 9/063* (2013.01); *F26B 2200/06* (2013.01)

(58) Field of Classification Search

CPC ..... F26B 9/063; F26B 21/004; F26B 25/10; F26B 25/06; F26B 17/12; F26B 2200/08; F26B 2200/06; B65D 88/745; B65D 3/06; B65D 88/72; B65D 88/742; B65D 88/28; B65D 88/741; B65D 88/26; B65D 2205/02; B67C 11/02

USPC ..... 454/173–183; 432/99

See application file for complete search history.

(56) References Cited

U.S. PATENT DOCUMENTS 3,365,813 A * 1/1968 Collins ..... F26B 17/1416 34/170
3,582,046 A * 6/1971 Mueller ..... B29B 7/04 366/106
3,713,564 A * 1/1973 Cottrell ..... B65D 88/706 222/1

(Continued)

*Primary Examiner* — Jessica Yuen
(74) *Attorney, Agent, or Firm* — McKee, Voorhees & Sease, PLC

(57) ABSTRACT

A hopper bottom for supporting a cylindrical side wall of a grain bin includes a hopper wall having an inverted cone shape supported on upright support legs. A manifold duct is supported above the hopper wall to define a manifold passage therein extending circumferentially adjacent to the peripheral edge of the hopper wall. A plurality of outlet openings formed in the manifold duct in communication from the manifold passage to an interior of the hopper wall for open communication with the grain bin thereabove. An inlet opening extending through the hopper wall in alignment with the manifold duct receives ventilation air from a blower to direct the flow through the manifold duct and into the grain bin through the outlet openings of the manifold duct.

20 Claims, 4 Drawing Sheets

(56) References Cited

U.S. PATENT DOCUMENTS

| | | | | |
|---|---|---|---|---|
| 4,520,714 | A * | 6/1985 | Gullickson | B65D 88/742 34/232 |
| 5,604,994 | A * | 2/1997 | Annen | F26B 17/12 34/314 |
| 8,677,648 | B2 * | 3/2014 | Schreiner | B65D 88/742 34/223 |
| 10,994,924 | B2 * | 5/2021 | Rosumowitsch | B65D 88/742 |
| 2013/0295833 | A1 * | 11/2013 | Thiessen | B65D 88/28 454/178 |
| 2014/0378044 | A1 * | 12/2014 | Thiessen | B65D 88/742 454/181 |

* cited by examiner

HOPPER BOTTOM FOR STORAGE BIN WITH INTEGRAL AERATION

This application claims the benefit under 35 U.S.C. 119(e) of U.S. provisional application Ser. No. 62/663,666 filed Apr. 27, 2018.

FIELD OF THE INVENTION

The present invention relates to a hopper bottom for supporting a storage bin thereon, for example a grain storage bin having a cylindrical side wall, and more particularly the present invention relates to a hopper bottom comprising an inner wall having an inverted cone shape which tapers downwardly and inwardly from a surrounding cylindrical outer wall support and aeration ducts for directing a flow of air upwardly into the grain storage bin.

BACKGROUND

Particulate material storage bins are commonly used on farms for storing the grain. In some instances it is desirable for the grain bin to comprise a hopper bottom which is generally conical so as to taper downwardly and inwardly to the center to assist in center unloading of the grain bin. Such hopper bottoms may be formed integrally with the grain bin or may be formed as a separate component upon which a commercially available cylindrical bin is then supported.

Examples of grain drying through a hopper cone are disclosed in U.S. Pat. No. 5,604,994 by Annen et al. and U.S. Pat. No. 4,520,714 by Gullickson. In the prior art examples considerable ducting or multiple blowers are required to communicate ventilation air to the various perforated sections in the hopper cone.

SUMMARY OF THE INVENTION

According to one aspect of the invention there is provided a hopper bottom for supporting a cylindrical side wall of a grain bin above a foundation, the hopper bottom comprising:

a hopper wall having an inverted cone shape so as to taper downwardly and inwardly from a peripheral edge at a top end of the hopper wall to a central opening at a bottom end of the hopper wall, the peripheral edge being arranged to support the cylindrical side wall of the grain bin thereabove;

a plurality of upright support members supporting the hopper wall above the foundation, each upright support member spanning between a bottom end arranged to be supported on the foundation and a top end supporting the hopper wall thereon;

a manifold duct supported above the hopper wall to define a manifold passage therein extending circumferentially about the hopper wall adjacent to the peripheral edge of the hopper wall;

a plurality of outlet openings formed in the manifold duct in communication from the manifold passage to an interior of the hopper wall for open communication with the grain bin thereabove, the outlet openings being located at circumferentially spaced apart locations relative to one another;

an inlet opening extending through the hopper wall in communication with the manifold passage, the inlet opening being arranged for communication with a blower so as to be arranged to direct ventilation air from the blower and into the grain bin through the manifold passage.

The location of the manifold passage above the hopper wall provides an exterior surface on the hopper wall which is unobstructed by ducting for unobstructed access to the area below the central discharge opening of the hopper wall. The communication of the manifold duct from a single inlet opening at the periphery to a plurality of circumferentially spaced apart outlet openings provides for an even distribution of aeration air into the hopper bottom and the resulting grain storage bin thereabove.

An upper boundary of the manifold duct is preferably sloped downwardly and inwardly from an outer edge of the duct.

Preferably, the outlet openings are the only openings in the manifold duct and the outlet openings are located within an upright boundary wall of the outlet duct. The inner boundary of the manifold duct may be defined by an inner wall which is cylindrical in shape and which locates the outlet openings therein.

A lower boundary of the manifold duct is preferably defined by a portion of the hopper wall and an upper boundary of the manifold duct is preferably defined by a plate which is supported spaced above of the hopper wall. The plate defining the upper boundary of the manifold duct may be frustoconical in shape and oriented parallel to the hopper wall.

The manifold duct preferably extends about a full circumference of the hopper wall.

The hopper bottom may further include a divider wall spanning the manifold duct at a location diametrically opposite from the inlet opening such that the manifold passage is generally C-shaped and such that the inlet opening is in communication with the manifold at a central location between opposing ends of the manifold passage.

The hopper bottom may further include one or more outlet ducts in which each outlet duct extends downwardly along the hopper wall from a respective one of the outlet openings to a bottom discharge opening of the outlet duct which is closer to the central opening of the hopper wall than the peripheral edge of the hopper wall.

Preferably, the bottom discharge opening is the only opening in each outlet duct.

The hopper bottom may further include a plurality of first outlet ducts connected to respective first ones of the outlet openings and a plurality of second outlet ducts connected to respective second ones of the outlet openings, the first outlet ducts having first discharge openings at inner ends thereof which are spaced radially outwardly from second discharge openings at inner ends of the second outlet ducts.

Preferably at least some of the outlet openings communicate directly with an interior volume of the hopper bottom at a location which is nearer to the peripheral edge of the hopper wall than the central opening of the hopper wall.

The hopper bottom may further include an inlet duct extending downwardly from the inlet opening in the hopper wall to a bottom end coupled to the blower.

BRIEF DESCRIPTION OF THE DRAWINGS

One embodiment of a hopper bottom for a grain storage bin with integral aeration will now be described in conjunction with the accompanying drawings in which.

In the drawings like characters of reference indicate corresponding parts in the different figures.

DETAILED DESCRIPTION

Figure 1:
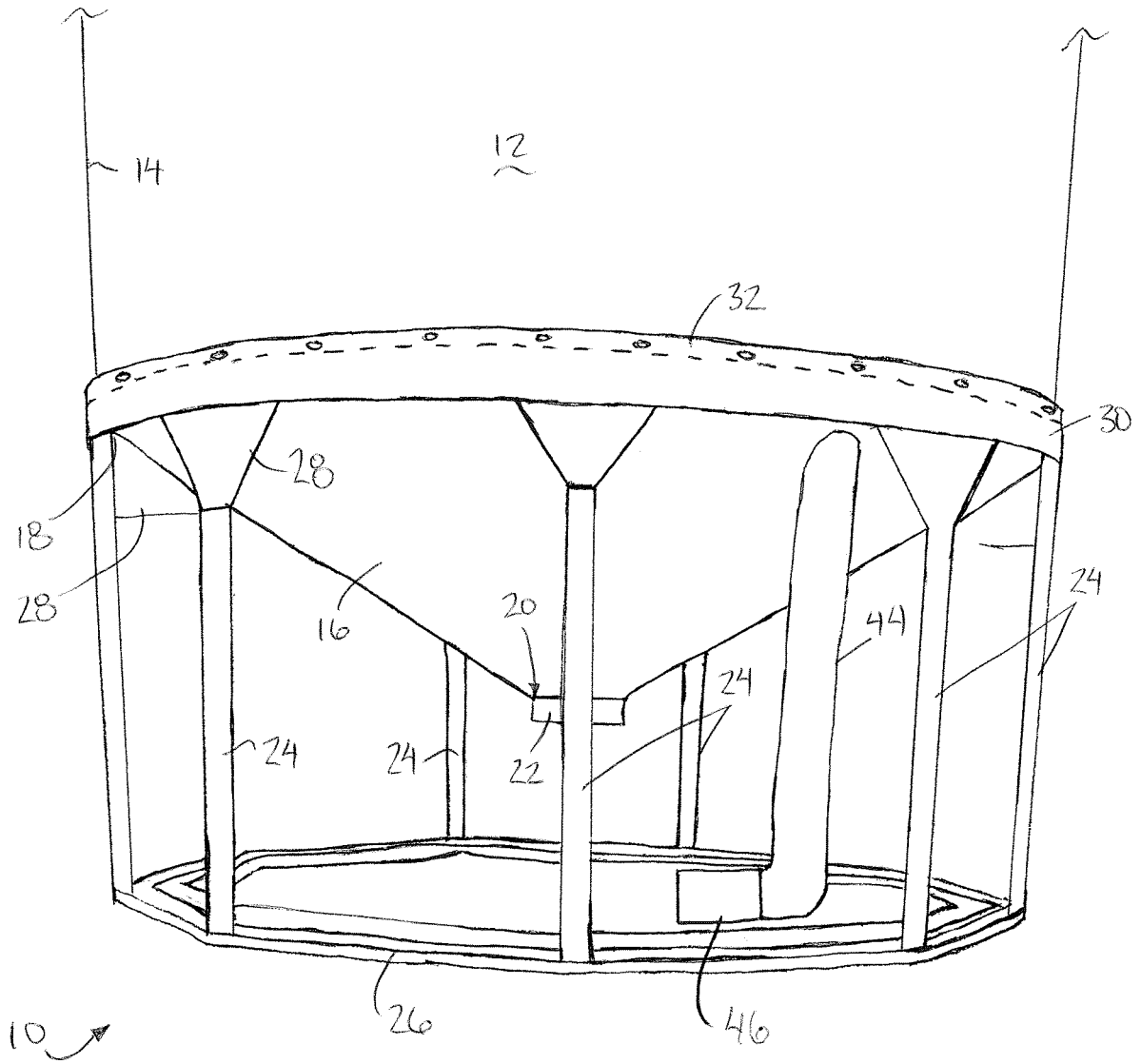
FIG. 1 is a perspective view of the hopper bottom supporting a grain storage bin thereon.
Figure 2:
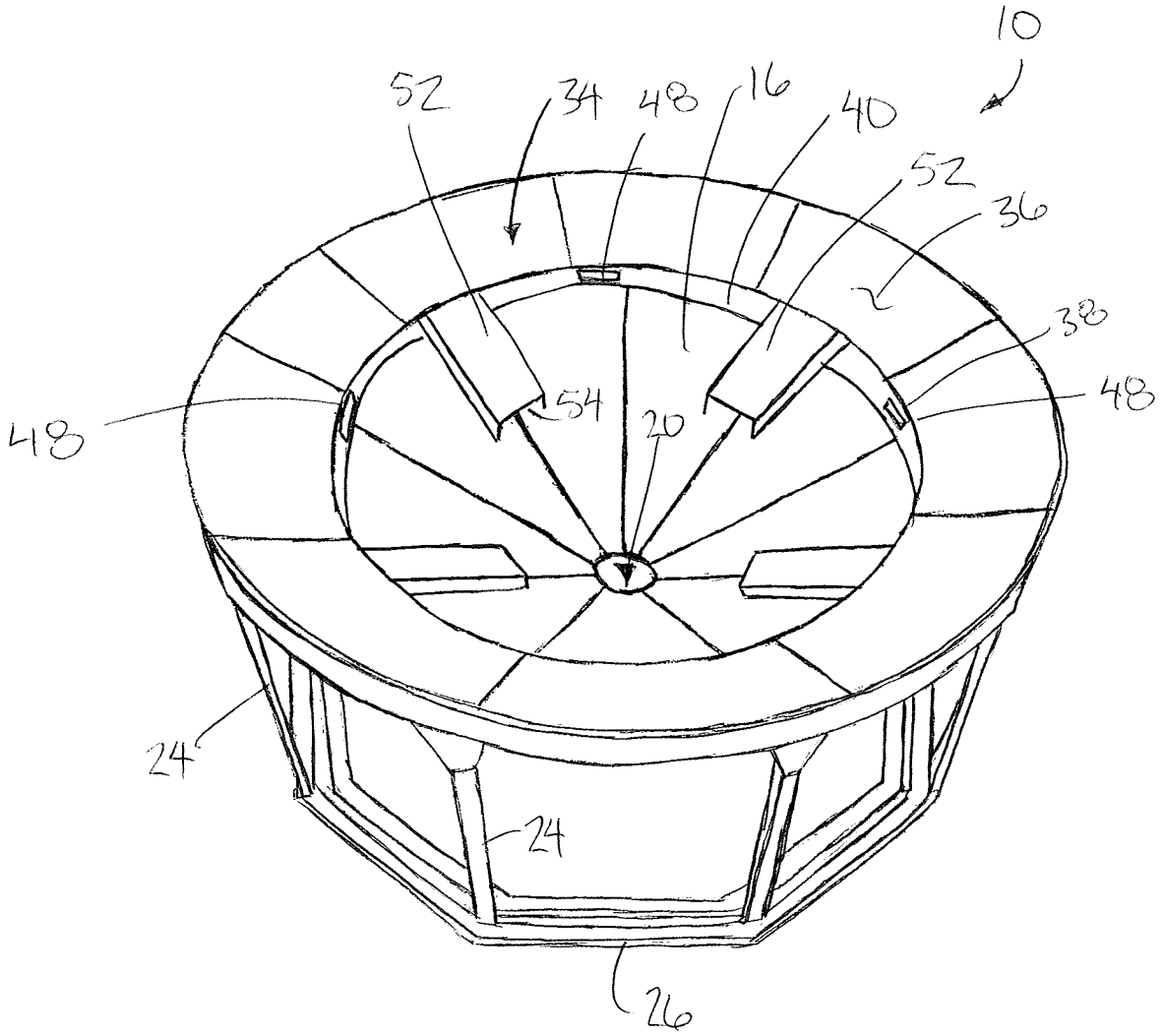
FIG. 2 is a perspective view of a top side of the hopper bottom shown with the grain storage bin removed therefrom.
Figure 3:
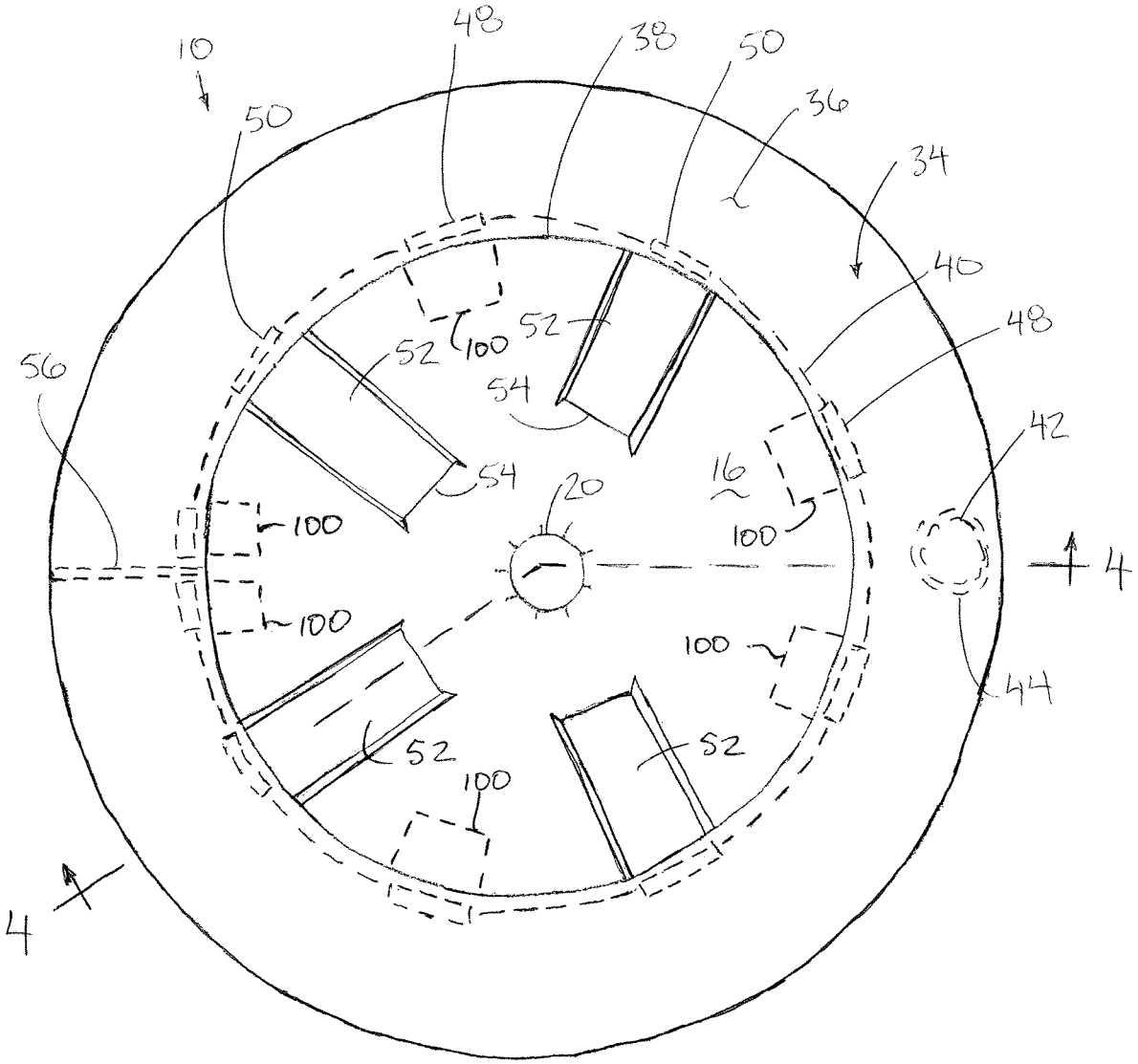
FIG. 3 is a top plan view of the hopper bottom shown with the grain storage bin removed therefrom.
Figure 4:
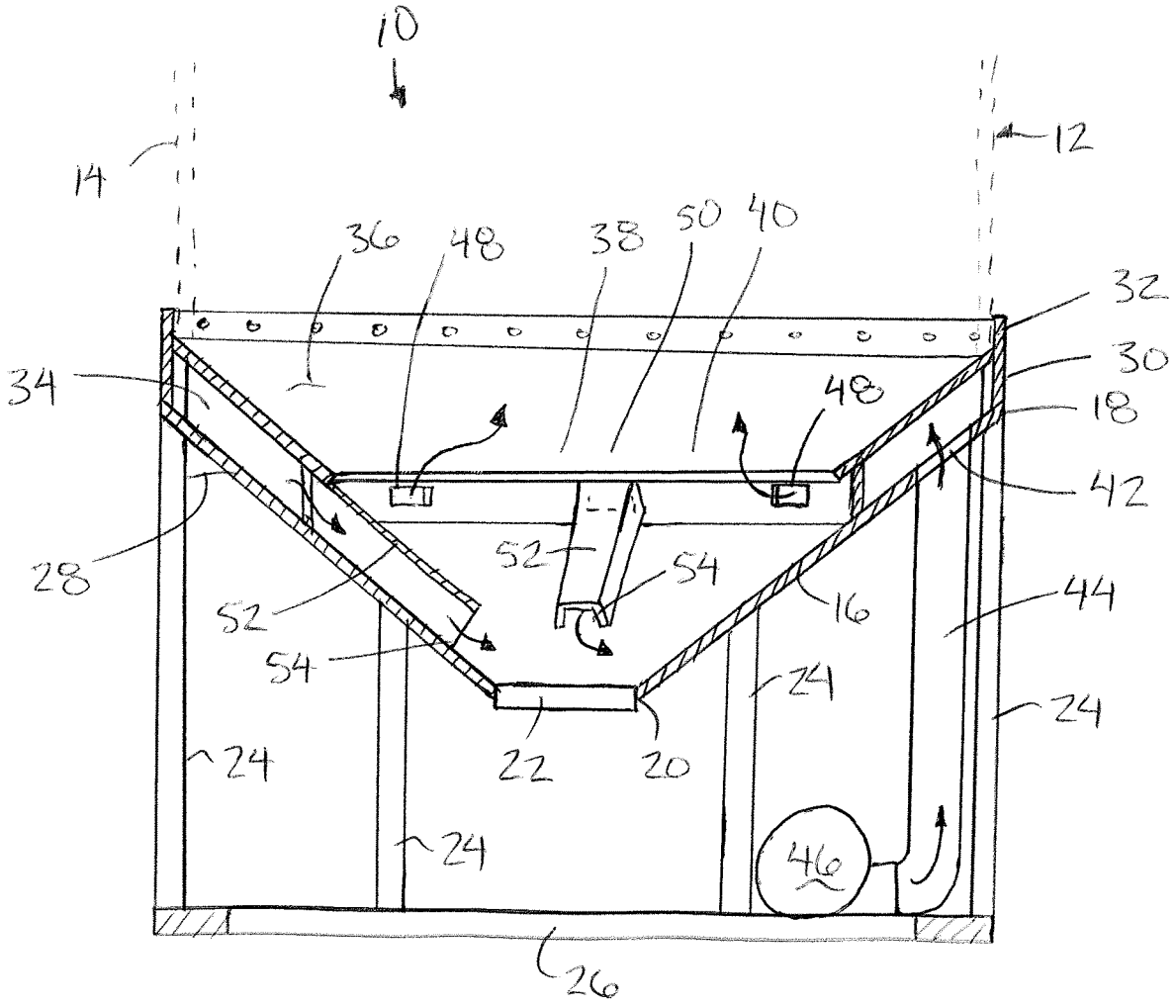
FIG. 4 is a sectional view along the line 4-4 in FIG. 3.

Referring to the accompanying figures, there is illustrated a grain storage bin hopper bottom generally indicated by reference numeral 10.

The hopper bottom 10 is particularly suited for a bin 12 of the type comprising a cylindrical side wall 14 extending vertically upward to be enclosed at the top end by a top wall (not shown). The top wall is typically conical in shape so as to taper upwardly and radially inwardly to a central opening at the top of the bin which can be selectively enclosed by a lid (not shown). The details of cylindrical grain storage bin are well known to persons of skill in the art and will not be described further herein.

The hopper bottom 10 includes a hopper wall 16 which is generally in the shape of an inverted cone. Accordingly, the hopper wall tapers downwardly and radially inwardly from a peripheral edge 18 at the top end of the hopper wall about the circumference of the hopper bottom towards a central discharge opening 20 at the bottom end of the hopper wall. The upper surface of the hopper wall 16 forms the lower boundary of a majority of an interior cone shaped volume of the hopper which is open to the hollow interior of the grain storage bin supported thereabove. A conventional gate assembly 22 is mounted at the bottom end of the hopper wall for operation between open and closed positions relative to the central discharge opening 20.

A set of support legs 24 are mounted at evenly spaced apart positions about the circumference of the hopper wall to extend vertically downwardly from the peripheral edge 18 thereof. Each support leg 24 is fixed to the bottom surface of the hopper wall such that an outer side of the support leg is substantially flush with the peripheral edge 18 of the hopper wall. The support legs are similar in height for spanning a common vertical distance between an annular footing member 26 at the bottom end and the peripheral edge 18 of the hopper wall at the top end. The annular footing 26 is a rigid annular member having a circumference which is approximately equal to the circumference of the peripheral edge of the hopper wall thereabove while lying in a plane which is parallel to a plane of the peripheral edge 18 of the hopper wall. The height of the support legs 24 is such that when the annular footing is engaged upon a suitable foundation, for example a ground surface, the gate assembly 22 at the central discharge opening at the bottom of the hopper wall is located spaced above the foundation by a suitable clearance for receiving the inlet hopper of suitable grain transfer equipment therebetween. A plurality of gussets 28 are provided at the junction of the support legs 24 with the hopper wall and with the annular footing 26 respectively.

The hopper bottom 10 further includes an outer wall 30 in the form of a cylindrical rim extending vertically upward from the peripheral edge 18 of the hopper wall. An upper portion of the upper wall defines a bolt flange 32 suitable for forming a lap joint in bolted connection to the bottom edge of the cylindrical wall 14 of the grain storage bin thereabove.

A manifold duct 34 is located above an upper portion of the hopper wall adjacent to the peripheral edge to extend about the full circumference of the hopper bottom. The manifold duct 34 is thus received within the interior volume defined by the hopper wall 16. The manifold duct defines a circumferentially extending manifold passage therein which is partly defined by an upper portion of the hopper wall which forms the lower boundary of the manifold duct. The lower portion of the outer wall 30 forms an outer boundary of the manifold passage.

At the top side of the manifold duct, the upper boundary of the manifold passage is defined by a top plate 36 which is mounted parallel to and spaced above the upper portion of the hopper wall. The top plate is thus generally frustoconical in shape. The outer edge of the top plate is joined in sealed relationship to the outer wall 30 at an intermediate location such that the portion of the outer wall 30 below the junction with the top plate defines the outer boundary of the manifold passage while the portion of the outer wall protruding upwardly above the top plate defines the bolt flange 32 for joining to the cylindrical wall of the grain storage bin thereabove.

The top plate extends downwardly and radially inwardly from the outer edge thereof at the outer wall to a circular inner edge 38 to define a radial width of the top plate which is less than half of the radius of the hopper wall, and more preferably is between one third and one quarter of the radius of the hopper wall. The resulting profile of the manifold passage is much wider in the radial direction than the vertical height such that the cross-sectional area of the manifold passage is elongate in the radial direction.

The manifold duct is further defined by an inner wall 40 which is generally cylindrical in shape and which spans vertically between the top plate and the corresponding location on the hopper wall 16 therebelow at a location spaced radially outward from the inner edge 38 such that the top plate protrudes radially inwardly beyond the inner wall 40. The inner wall thus encloses the manifold passage at the inner end thereof across the full height and about the full circumference of the manifold duct.

A single inlet opening 42 is formed to extend through the hopper wall in alignment with and in communication with the manifold passage at a location adjacent the peripheral edge of the hopper wall. A suitable inlet duct 44 is provided as a vertical duct spanning between the inlet opening 42 at the top end and a bottom end at the elevation of the annular footing such that the inlet duct 44 extends alongside one of the support legs along the full length thereof. A suitable blower fan 46 is supported on the footing 26 or on the foundation in communication with the bottom end of the inlet duct for blowing air into the inlet duct 44 which in turn communicates through the inlet opening 42 into the manifold passage. In further embodiments, the blower fan 46 may instead be directly coupled to the inlet opening 42 by supporting the blower fan externally on the bottom side of the hopper wall 16.

Air is exhausted from the manifold passage through a plurality of outlet openings including first outlet openings 48 and second outlet openings 50 which are located within the inner wall 40 at evenly spaced apart positions in a circumferential direction. The combined area of the outlet openings 48 and 50 is much smaller than the total area occupied by the inner wall 40 such that the majority of the inner boundary of the manifold passage is enclosed by the inner wall 40 rather than being open at the outlet openings 48 and 50.

The first outlet openings 48 are uncovered and allow air flow from the manifold passage to exit therethrough directly into the interior volume of the hopper and the grain storage bin thereabove at a location which is closer to the peripheral edge of the hopper wall than the central discharge thereof. The top plate protruding radially inwardly beyond the inner wall 40 defines an overhang over each opening 48 which prevents material within the bin from entering the manifold duct through the first outlet openings 48. Perforated screen members may also be provided across each first inlet opening 48 to further resist penetration of material into the manifold duct from the bin.

Alternatively, the second outlet openings 50 are each provided with an outlet duct 52 associated therewith in which the outlet duct is an enclosed duct that extends radially downwardly and inwardly along the inner surface of the hopper wall from the outlet opening to an inner end of the duct defining a discharge opening 54 therein. The discharge opening 54 is in open communication with the interior of the hopper at a location which is closer to the central discharge of the hopper wall than the peripheral edge thereof. Each outlet duct 52 is defined by an inverted U-shaped member defining an upper boundary and opposing side boundaries of the duct, while the hopper wall against which the U-shaped member is mounted defines the lower boundary of the duct. Each outlet duct thus defines an outlet passage therethrough which extends downwardly and radially inwardly along the upper surface of the hopper wall from an upper end in communication with the respective outlet opening 50 to a bottom end which discharges into the interior of the grain storage bin. Each outlet duct 52 is coupled at an outermost end to the inner wall 40 so as to surround the respective outlet opening 50. Each outlet duct is thus located fully externally of the manifold duct.

The boundaries of the manifold duct and the outlet duct are all formed of rigid, solid, and non-perforated material that form the top plate 36, the inner wall 40, and the U-shaped member of each outlet duct 52.

A suitable divider member 56 is mounted within the manifold duct at a location which is diametrically opposite from the inlet opening. The divider plate 56 spans the full cross-section of the manifold duct such that the manifold passage is effectively C-shaped between two opposing ends of the passage defined at opposing sides of the divider member 56. The inlet opening 42 in this instance is located centrally in the circumferential direction between the two opposing ends of the manifold passage that are defined at the opposing sides of the divider plate 56.

In use, a blower is mounted in communication with the bottom end of the inlet duct 44 for blowing aeration air up through the inlet duct and into the manifold duct through the inlet opening 42 in the hopper wall. Upon entering the manifold passage, the airflow is split in two opposing circumferential directions within the manifold passage from the inlet opening 42 towards the opposing ends of the passage defined at opposing sides of the divider plate 56 respectively. As the flow of air through the manifold passage flows circumferentially past each of the outlet openings 48 and 50, the air is exhausted from the manifold passage through the outlet openings for being discharged directly into the interior of the grain bin at the first outlets 48 or alternatively being directed through respective second outlets 50 into outlet ducts 52 which then discharge into the interior of the grain bin.

In further embodiments, there may be provided an auxiliary duct 100 at each of the first outlets 48 which is identical in configuration to the outlet ducts 52 with the exception of each auxiliary duct 100 being much shorter in length in the radial direction compared to the length of the outlet ducts. In this manner, air ducted through the second outlets 50 and the associated outlet ducts 52 is discharged into the bin at a common first radial distance from the central discharge opening, while the air ducted through the first outlets 48 and the associated auxiliary ducts 100 is discharged into the bin at a common second radial distance from the central discharge opening which is greater than the first radial distance. The discharge openings at the inner ends of the auxiliary ducts 100 are located closer to the outer peripheral edge than the central discharge opening of the hopper cone.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A hopper bottom for supporting a cylindrical side wall of a grain bin above a foundation, the hopper bottom comprising:

a sloped hopper wall having an inverted cone shape so as to taper downwardly and inwardly from an upper peripheral edge at a top end of the hopper wall to a central opening at a bottom end of the hopper wall, the peripheral edge being arranged to support the cylindrical side wall of the grain bin there above;

a plurality of upright support members supporting the hopper wall above the foundation, each upright support member spanning between a bottom end arranged to be supported on the foundation and a top end supporting the hopper wall thereon;

a toroidal manifold duct above the hopper wall extending circumferentially about the sloped hopper wall adjacent to the upper peripheral edge of the hopper wall;

a plurality of outlet openings formed in the manifold duct adjacent the sloped hopper wall to an interior of the sloped hopper wall for open communication with the grain bin there above, the outlet openings residing above the sloped hopper wall and being located at circumferentially spaced apart locations relative to one another to direct air inwardly;

an air inlet opening extending through the hopper wall in communication with the manifold duct, the inlet opening being arranged for communication with a blower so as to direct ventilation air from the blower and into the grain bin through the manifold duct.

2. The hopper bottom according to claim 1 wherein an upper boundary of the manifold duct is sloped downwardly and inwardly from an outer edge of the duct.

3. The hopper bottom according to claim 1 wherein the outlet openings are located within an upright boundary wall of the manifold duct.

4. The hopper bottom according to claim 1 wherein a lower boundary of the manifold duct is defined by a portion of the hopper wall and an upper boundary of the manifold duct is defined by a plate which is supported spaced above of the hopper wall.

5. The hopper bottom according to claim 4 wherein the plate defining the upper boundary of the manifold duct is frustoconical in shape.

6. The hopper bottom according to claim 4 wherein the plate defining the upper boundary of the manifold duct is parallel to the hopper wall.

7. The hopper according to claim 1 wherein an inner boundary of the manifold duct is defined by an inner wall which is cylindrical in shape.

8. The hopper bottom according to claim 7 wherein the outlet openings are located in the inner wall of the manifold duct.

9. The hopper bottom according to claim 1 further comprising a divider wall spanning the manifold duct at a location diametrically opposite from the inlet opening such that the manifold duct is generally C-shaped and the inlet opening is in communication with the manifold duct at a central location between opposing ends of the manifold duct.

10. The hopper bottom according to claim 1 further comprising an outlet duct in communication with at least one of the outlet openings, and the outlet duct extends downwardly along the hopper wall from the outlet opening to terminate in a bottom discharge opening of the outlet duct.

11. The hopper bottom according to claim 10 further comprising a plurality of first outlet ducts connected to respective first ones of the outlet openings and a plurality of second outlet ducts connected to respective second ones of the outlet openings, the first outlet ducts having first discharge openings at inner ends thereof which are spaced radially outwardly from second discharge openings at inner ends of the second outlet ducts.

12. The hopper bottom according to claim 1 further comprising an inlet duct extending downwardly from the inlet opening in the hopper wall to a bottom end coupled to the blower.

13. The hopper bottom according to claim 1 wherein the manifold duct is non-perforated.

14. The hopper bottom according to claim 1 wherein the manifold duct has a parallelogram cross-sectional shape.

15. The hopper bottom according to claim 1 wherein the support members are separate from the air inlet.

16. A hopper bottom for a grain bin having cylindrical sidewall supported on legs, the hopper bottom comprising:

a sloped floor extending downwardly and inwardly from the sidewall;

an air inlet extending through the sloped floor;

a circumferentially extending manifold duct on top of the sloped floor adjacent the sidewall and connected to the air inlet;

a plurality of outlet opening in the manifold duct to direct air downwardly along the sloped floor from the manifold duct.

17. The hopper bottom of claim 15 wherein the air inlet is apart from the legs.

18. The hopper bottom of claim 15 wherein the manifold duct is non-perforated.

19. The hopper bottom of claim 15 wherein the manifold duct is a parallelogram in cross section.

20. The hopper bottom of claim 15 further comprising a plurality of non-perforated outlet ducts, with each outlet duct being associated with one of the outlet openings and extending downwardly on top of the sloped floor from the manifold duct.

* * * * *